US012263873B2

(12) United States Patent
Pan et al.

(10) Patent No.: US 12,263,873 B2
(45) Date of Patent: Apr. 1, 2025

(54) IMPLEMENTATION METHOD FOR INDEPENDENT MULTIMODE TRAIN CONTROL SYSTEM BASED ON TRACKSIDE PLATFORM

(71) Applicant: CASCO SIGNAL LTD., Shanghai (CN)

(72) Inventors: Liang Pan, Shanghai (CN); Xiaoyong Wang, Shanghai (CN); Yanyang Xing, Shanghai (CN); Haigui Xu, Shanghai (CN); Huaxiang Liu, Shanghai (CN); Lingjiao Hong, Shanghai (CN); Shaowen Chen, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 144 days.

(21) Appl. No.: 18/013,261

(22) PCT Filed: Jan. 6, 2022

(86) PCT No.: PCT/CN2021/128591
§ 371 (c)(1),
(2) Date: Dec. 28, 2022

(87) PCT Pub. No.: WO2022/193679
PCT Pub. Date: Sep. 22, 2022

(65) Prior Publication Data

US 2023/0257013 A1 Aug. 17, 2023

(30) Foreign Application Priority Data

Mar. 17, 2021 (CN) ..... 202110288527.9

(51) Int. Cl.
*B61L 27/70* (2022.01)
*B61L 27/20* (2022.01)
*B61L 27/30* (2022.01)

(52) U.S. Cl.
CPC ..... *B61L 27/70* (2022.01); *B61L 27/20* (2022.01); *B61L 27/30* (2022.01); *B61L 2027/204* (2022.01)

(58) Field of Classification Search
CPC ..... B61L 27/70; B61L 27/30
See application file for complete search history.

(56) References Cited

U.S. PATENT DOCUMENTS 7,269,487 B2 * 9/2007 Watanabe ..... B61L 25/025 701/19
8,714,494 B2 * 5/2014 Weber ..... B61L 15/0027 701/19

(Continued)

OTHER PUBLICATIONS

"International Search Report (Form PCT/ISA/210) of PCT/CN2021/128591", mailed on Jan. 27, 2022, with English translation thereof, pp. 1-6.

*Primary Examiner* — Long T Tran
(74) *Attorney, Agent, or Firm* — JCIPRNET

(57) ABSTRACT

An implementation method for an independent multimode train control system based on a trackside platform is provided. According to the implementation method, a trackside train control system and an interlocking system are provided independently to meet requirements of hybrid operation of trains having different systems; and at the same time, during operation of a train in a moving block mode, once a trackside control system fails or an on-board system fails, the multimode train control system can ensure that the train is degraded automatically and operates according to a degraded mode.

8 Claims, 3 Drawing Sheets

(56) References Cited

U.S. PATENT DOCUMENTS

| | | | | |
|---|---|---|---|---|
| 9,290,191 | B2 * | 3/2016 | Ghaly | B61L 25/026 |
| 9,731,738 | B2 * | 8/2017 | Carlson | B61L 27/20 |
| 9,751,540 | B2 * | 9/2017 | Cook | B61C 17/12 |
| 10,778,363 | B2 * | 9/2020 | Carlson | B61L 3/125 |
| 10,843,716 | B2 * | 11/2020 | Ghaly | B61L 19/06 |
| 2010/0299007 | A1 * | 11/2010 | Ghaly | B61L 15/0062 701/20 |
| 2015/0232110 | A1 * | 8/2015 | Ghaly | B61L 15/0018 246/62 |
| 2021/0287459 | A1 * | 9/2021 | Cella | G07C 5/0808 |

* cited by examiner

IMPLEMENTATION METHOD FOR INDEPENDENT MULTIMODE TRAIN CONTROL SYSTEM BASED ON TRACKSIDE PLATFORM

CROSS-REFERENCE TO RELATED APPLICATION

This application is a 371 of international application of PCT application serial no. PCT/CN2021/128591, filed on Jan. 6, 2022, which claims the priority benefit of China application no. 202110288527.9, filed on Mar. 17, 2021. The entirety of each of the above-mentioned patent applications is hereby incorporated by reference herein and made a part of this specification.

BACKGROUND

Technical Field

The present invention relates to a train signal control system, and in particular, to an implementation method for an independent multimode train control system based on a trackside platform.

Description of Related Art

In order to meet the operation requirements of multi-network integration in rail transit, a train control system needs to fulfill the function of operating trains in a degraded mode supported by conventional interlocking, and also needs to take the operation of trains having a moving block system into consideration.

At present, during the extension, transformation, and upgrading of railway, urban, or rail transit signal engineering projects, the requirements for smooth transition, disturbance-free transformation, and compatibility between the old and the new are put forward in order to ensure that the public travel is not affected.

Under the current railway technical standard system, these can be established again only if all sections within a route coverage are cleared and the sections are unlocked. Therefore, the larger the route coverage, the longer the time interval between preceding and posterior trains for dealing with the route. For a train control system in a moving block mode, the incoming and outgoing capabilities of the entire system are restricted due to the technical conditions on route.

Therefore, in an existing line transformation project, how to avoid or reduce the interference with the existing operating system and achieve the compatibility in hybrid operation of trains having a variety of system has become an urgent technical problem to solve.

Based on searches, a Chinese patent with Publication No. CN110920694A discloses a method for interconnectively switching between a CBTC system and a CTCS system. The method specifically includes: installing two sets of on-board devices suitable for both CBTC and CTCS systems on a train, and providing, on a line, a switching transition region for the CBTC and CTCS systems to allow region-crossing switching for the train, with relevant signal devices arranged at a boundary of the switching transition region. However, two sets of on-board devices need to be installed on the train in this prior art, which greatly increases the manufacturing cost.

SUMMARY

An object of the present invention is to overcome the defects existing in the prior art above, and to provide an implementation method for an independent multimode train control system based on a trackside platform. The method avoids or reduces the interference with existing operation systems and at the same time, is compatible with the hybrid operation of trains having a variety of systems.

The object of the present invention can be achieved by means of the following technical solutions.

According to one aspect of the present invention, there is provided an implementation method for an independent multimode train control system based on a trackside platform. According to the implementation method, a trackside train control system and an interlocking system are provided independently to meet requirements of hybrid operation of trains having different systems; and at the same time, during operation of a train in a moving block mode, once a trackside control system fails or an on-board system fails, the multimode train control system can ensure that the train is degraded automatically and operates according to a degraded mode.

As a preferred technical solution, when receiving an application for a movement authority from a dispatching supervision system for a specified operating train, the trackside control system determines a direction of the movement authority according to a destination and a path in the application for the movement authority, and calculates a starting point of the movement authority on the basis of a safe rear position of the train, and an end point of the movement authority depends on whether an obstacle point exists on the whole path applied for the movement authority.

As a preferred technical solution, if no obstacle point exists on the whole path applied for the movement authority, the end point of the movement authority is used to define a farthest distance for the movement authority of the train, and if an obstacle point exists on the path applied for the movement authority, the end point of the movement authority will be extended or withdrawn to the obstacle point; and between the obstacle point and the destination of the applied movement authority, the trackside control system will activate the movement authority to an applied state.

As a preferred technical solution, if the obstacle point is a turnout, which is not located at a desired position of the movement authority and is in a region with a movement authority applied state, and in the event that other conditions of a permissible action of the turnout are satisfied, the trackside control system outputs a turnout operating command to the interlocking system, and once a position of the turnout reaches the desired position of the movement authority, the trackside control system will send a turnout locking command to the interlocking system; and if the trackside control system receives a state that the turnout is a locked by the movement authority, and no obstacle point exists between the train and a section in which the turnout is located, a movement authority for the section of the turnout is activated for the train.

As a preferred technical solution, if a range of the movement authority covers a segment of train route in the same direction, the trackside control system sends, to the interlocking system, a train route establishment command, and in the event that relevant conditions of the route are satisfied, the interlocking system locks the route and clears a signal; and in the event that the movement authority has been established, if a condition for establishing a route within a range of the movement authority is not satisfied, the interlocking system sends a logical clearing state of a route starting-terminal signal machine to a train control center, and for a turnout that has been locked by the movement authority, the interlocking system sends a section locked state of the section, where the turnout is located, to the train control center, and if degradation occurs at any time, the train can be controlled on the basis of a track circuit system to maintain subsequent operation.

As a preferred technical solution, a section direction is triggered by a route handled by the interlocking system, and once the section direction is established and the movement authority applied by the dispatching system for the train is consistent with the section direction, a corresponding movement authority is established on the basis of a front obstacle point.

As a preferred technical solution, the implementation method includes: a process of establishing a movement authority; a process of releasing the movement authority; and a process of manually releasing the movement authority.

As a preferred technical solution, the process of establishing the movement authority specifically includes:

a1) applying a movement authority for a train by the dispatching supervision system according to an operation plan, and sending a movement authority applying for a current portion of line to the trackside control system;

a2) in case of the movement authority applied for the train, checking, by the trackside control system, whether a movement authority condition is satisfied within a range of the applied movement authority, if the movement authority condition is satisfied with respect to all or a portion of the line for which the movement authority is applied, checking whether the current portion of line for which the movement authority is applied includes a turnout, and if the movement authority condition is not satisfied with respect to all regions or a portion of the line within the range of the applied movement authority, activating, by the trackside control system, a movement authority applied state for all or a portion of the line that does not satisfy the condition, and continuously checking the movement authority condition within the line;

a3) if the movement authority condition is satisfied with respect to all or a portion of the line for which the movement authority is applied and the current portion of the line includes a turnout, checking and determining, by the trackside control system, whether a turnout position is a desired position of the movement authority applied, if not, outputting a turnout operating command to the interlocking system, which in turn outputs, upon receipt, the turnout operating command to a trackside turnout switch machine, acquires a turnout position state from a trackside signal device in real time, and sends the turnout position state to the dispatching supervision system, and if so, sending, by the trackside control system, an indication of locking all turnouts in the portion of line to the interlocking system, which in turn sends a turnout locked state to the dispatching supervision system;

a4) if the movement authority condition is satisfied with respect to all or a portion of the line for which the movement authority is applied, checking, by the trackside control system, whether an obstacle point exists in front of the train within a destination line range in a current train operation plan, regardless of whether the turnout is included within the range of the line;

a5) if the trackside control system checks an obstacle point existing in front of the train within the destination line range in the current train operation plan, detecting, in real time, whether the front obstacle point is cleared, and updating and establishing the movement authority from the train to the obstacle point;

a6) after the interlocking system locks the turnout, activating, by the interlocking system, a turnout movement authority locked state, which can be unlocked only by the trackside control system, checking, by the trackside control system, whether a train route in the same direction as the movement authority is included within the range of the movement authority, if so, sending a route establishment command to the interlocking system, checking, by the interlocking system, whether a route condition is satisfied, if satisfied, locking a route and clearing a signal, and if not satisfied, maintaining a current state of the route;

a7) if the trackside control system checks that an obstacle point in front of the train within the destination line range in the current train operation plan is removed, establishing a movement authority from the train to the destination of the operation plan, and sending a movement authority state to the dispatching supervision system;

a8) operating the train in the moving block mode to the end point of the currently established movement authority according to the range of the movement authority;

a9) if the interlocking system determines that the route is locked, outputting a signal clearing command to a trackside signal machine, which sends, after receiving a signal cleared state, the signal cleared state to the dispatching supervision system; and a10) operating the train in the degraded mode according to the clearing signal and according to signal display.

As a preferred technical solution, the process of releasing the movement authority specifically includes:

b1) after establishing the movement authority for the train in the moving block mode, operating the train on the basis of the target point and direction according to the movement authority;

b2) determining, by the trackside control system, whether the safe rear position of the train is in a turnout region, if not, moving the train along the direction of the movement authority on the basis of the rear position of the train, releasing a movement authority for a current movement displacement distance, and sending a state to the dispatching supervision system, and if so, checking that the safe rear position of train has been cleared from a segment of the turnout region;

b3) determining, by the trackside control system, that the safe rear position of train has been cleared from a segment of the turnout region, releasing a movement authority for the region where the turnout is located, and sending, to the interlocking system, a command of releasing a movement authority locked state of the turnout and unlocking a turnout section;

b4) sending, by the trackside control system, a movement authority released state of the turnout region to the dispatching supervision system; and b5) sending, by the interlocking system, a turnout unlocked state and a section locked state to the dispatching supervision system after receiving the command of releasing the movement authority locked state of the turnout and unlocking the turnout section.

As a preferred technical solution, the process of manually releasing the movement authority specifically includes:

c1) handling, by a dispatching terminal, a movement authority cancellation command in the dispatching supervision system, and sending, by the dispatching supervision system, the command to the trackside control system;

c2) determining, by the trackside control system, whether the train is in the moving block mode, and if so, calculating a target point, at which the train is ensured to stop, on the basis of information on current speed per hour and line grade in the received movement authority cancellation command;

c3) determining, by the trackside control system, that the train is not in the moving block mode, sending to the interlocking system a command of canceling a route within the range of the movement authority, checking, by the interlocking system, whether a front route of the train is in approach locking and simultaneously checking whether a signal in front of the train is cleared, if the signal is cleared, sending a signal closing command to a trackside signal machine, and after a closed state of the signal machine is acquired, sending, by the interlocking system, a signal closed state to the dispatching supervision system;

c4) after the interlocking system receives the movement authority cancellation command, starting, by the interlocking system, a route-unlocking delay timer if the interlocking system determines that the route in front of the train is in approach locking;

c5) when timing of the route-unlocking delay timer is over and no section is occupied within a route coverage, or when the route in front of the train is not in approach locking as a route cancellation command is received from the trackside control system, unlocking, by the interlocking system, the route in front of the train and a turnout in the route;

c6) after the trackside control system determines the target point at which the train is ensured to stop, releasing, if a region covered by the movement authority is greater than a range of the target point at which the train is ensured to stop, a movement authority for a region outside the range of the target point at which the train is ensured to stop;

c7) checking, by the trackside control system, whether the released region with the movement authority includes a turnout, if a turnout is included, sending, to the interlocking system, a command of releasing a movement authority locked state of the turnout, executing, by the interlocking system, releasing of turnout locking, and then, sending, by the interlocking system, a turnout unlocked state to the dispatching supervision system; and c8) after the route in front of the train is unlocked, unlocking a section and sending a section unlocked state to the dispatching supervision system, by the interlocking system.

Compared with the prior art, the present invention has the following advantages:

1) the trackside train control system and an interlocking system platform are provided independently to meet the requirements of the existing line transformation and transition projects for signal systems;

2) interlocking is adapted to the degraded mode and is functionally compatible with the interfaces of CTCS-2- and CTCS-3-level train control systems of China Railway, with few functional changes in the interlocking system, such that the safety and usability of the system is improved;

3) the movement-block train control system is compatible with the conventional interlocking system to achieve seamless switching between different modes, which ensures system usability; and 4) the requirements of hybrid operation of trains having a variety of systems are satisfied, and the method is suitable for lines with multi-network integration.

DESCRIPTION OF THE EMBODIMENTS

Figure 1:
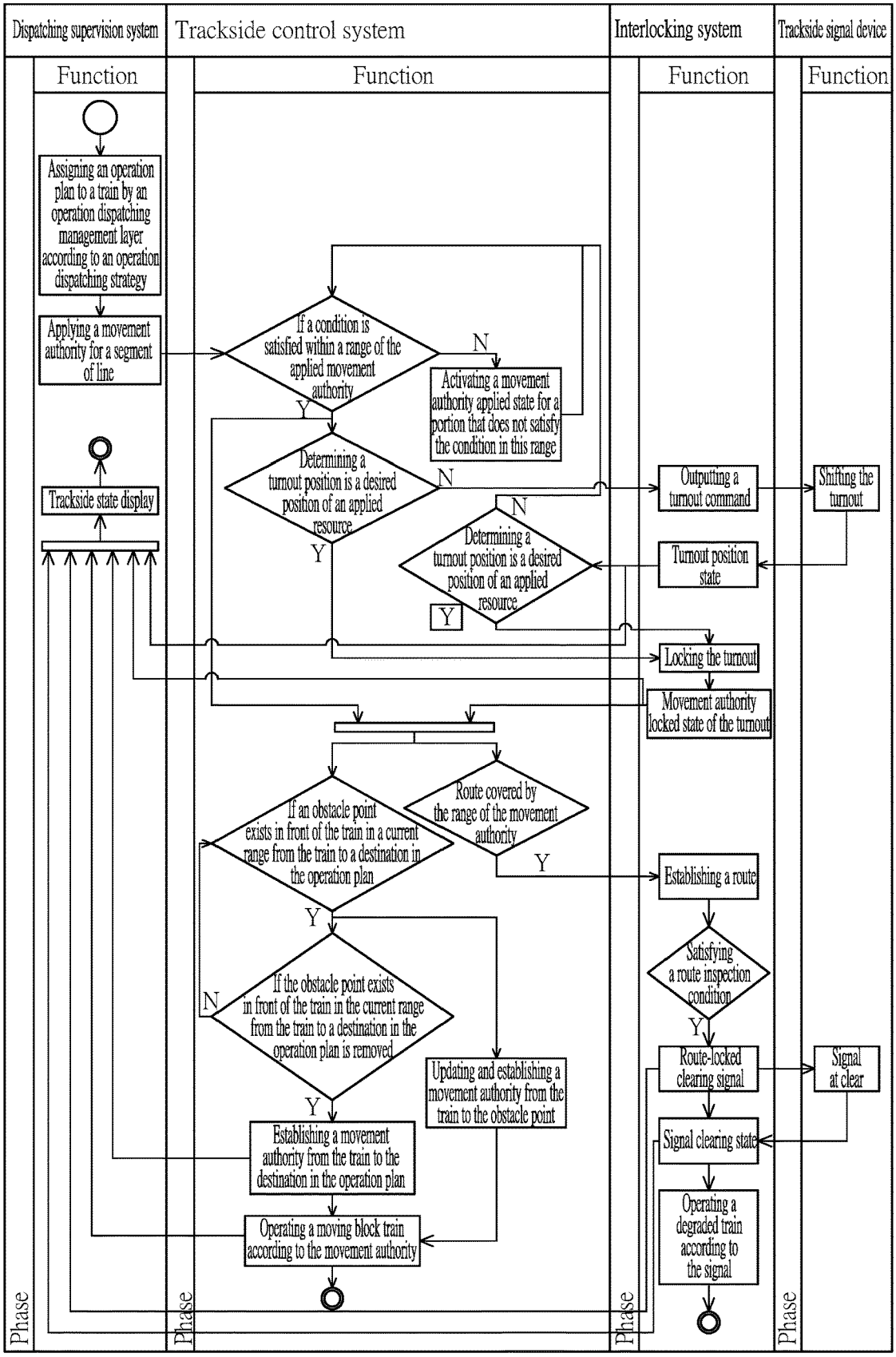
FIG. 1 is a flowchart of a process of establishing a movement authority according to the present invention.

The technical solutions in the embodiments of the present invention will be described clearly and completely below in conjunction with the accompanying drawings in the embodiments of the present invention. Obviously, the embodiments described are some instead of all of the embodiments of the present invention. Based on the embodiments in the present invention, every other embodiment obtained by those of ordinary skills in the art without creative labor shall fall within the protection scope of the present invention.

At present, trunk railway lines in China are based on the China train control system (CTCS), and the urban rail transit is basically base on the communication-based train control system (CBTC). Due to the different signal system standards, railway trains provided with a single-mode on-board signal system cannot directly enter an urban rail transit region, resulting in that these two types of rail transits cannot be connected. To this end, there is a need of a solution to a multimode train control system compatible with both the CTCS and CBTC systems.

In order to meet the operational performance requirements of the moving block mode and ensure the compliance with the established technical conditions on route in the degraded mode, the present invention provides a solution of an independent multimode train control system based on a trackside platform. The present invention is intended for a double-set signal system in which a track circuit-based train control (TBTC) system and the CBTC system are used, and is also applicable to the CTCS system, the ETCS system, the PTC system, the ITCS system, the TACS system, and other signal systems in other modes. Therefore, the claims of the present method are also applicable to these systems and systems similar thereto.

Its main purpose is that, during the operation of a train in a moving block mode, once a trackside control system fails or an on-board system fails, the system can ensure to perform degradation so as to maintain the operation of the train in the degraded mode.

When receiving an application for a movement authority from a dispatching supervision system for a specified operating train, the trackside control system determines a direction of the movement authority according to a destination and a path in the application for the movement authority, and calculates a starting point of the movement authority on the basis of a safe rear position of the train, and an end point of the movement authority depends on whether an obstacle point exists on the whole path applied for the movement authority.

If no obstacle point (such as a locked signal device, a head-on or lateral conflicting movement authority or route, or an additional train occupied) exists on the whole path applied for the movement authority, the end point of the movement authority is used to define a farthest distance for the movement authority of the train; and if an obstacle point exists on the path applied for the movement authority, the end point of the movement authority will be extended or withdrawn to the obstacle point. Between the obstacle point and the destination of the applied movement authority, the trackside control system will activate the movement authority to an applied state.

If the obstacle point is a turnout, which is not located at a desired position of the movement authority and is in a region with a movement authority applied state, and in the event that other conditions of a permissible action of the turnout are satisfied (for example, there is no train occupancy or it is not in the unlocked state, etc.), the trackside control system outputs a turnout operating command to the interlocking system. Once a position of the turnout reaches the desired position of the movement authority, the trackside control system will send a turnout locking command to the interlocking system. If the trackside control system receives a state that the turnout is a locked by the movement authority, and no obstacle point exists between the train and a section in which the turnout is located, a movement authority for the section of the turnout is activated for the train.

If a range of the movement authority covers a segment of train route in the same direction, the trackside control system sends, to the interlocking system, a train route establishment command, and in the event that relevant conditions of the route are satisfied, the interlocking system locks the route and clears a signal.

In the event that the movement authority has been established, if a condition for establishing a route within a range of the movement authority is not satisfied, the interlocking system sends a logical clearing state of a route starting-terminal signal machine to a train control center. For a turnout that has been locked by the movement authority, the interlocking system sends a section locked state of the section, where the turnout is located, to the train control center, such that, during the operation of the train that has entered the route, if degradation occurs at any time, the train can be controlled on the basis of a track circuit system to maintain subsequent operation.

A section direction is triggered by a route handled by the interlocking system. Once the section direction is established and the movement authority applied by the dispatching system for the train is consistent with the section direction, a corresponding movement authority is established on the basis of a front obstacle point.

Referring to FIG. 1, the implementation steps of establishing the movement authority according to the present invention are introduced as follows.

In a1), the dispatching supervision system applies a movement authority for a train according to an operation plan, and sends a movement authority applying for a current portion of line to the trackside control system.

In a2), in case of the movement authority applied for the train, the trackside control system checks whether a movement authority condition is satisfied (for example, in terms of the movement authority in an opponent operation direction, the occupancy by other trains, etc.) within a range of the applied movement authority; if the movement authority condition is satisfied with respect to all or a portion of the line for which the movement authority is applied, whether the current portion of line for which the movement authority is applied includes a turnout is checked; and if the movement authority condition is not satisfied with respect to all regions or a portion of the line within the range of the applied movement authority, the trackside control system activates a movement authority applied state for all or a portion of the line that does not satisfy the condition, and continuously checks the movement authority condition within the line.

In a3), if the movement authority condition is satisfied with respect to all or a portion of the line for which the movement authority is applied and the current portion of the line includes a turnout, the trackside control system checks and determines whether a turnout position is a desired position of the movement authority applied; if not, a turnout operating command is output to the interlocking system, which in turn outputs, upon receipt, the turnout operating command to a trackside turnout switch machine, acquires a turnout position state from a trackside signal device in real time, and sends the turnout position state to the dispatching supervision system; and if so, the trackside control system sends an indication of locking all turnouts in the portion of line to the interlocking system, which in turn sends a turnout locked state to the dispatching supervision system.

In a4), if the movement authority condition is satisfied with respect to all or a portion of the line for which the movement authority is applied, the trackside control system checks whether an obstacle point exists in front of the train within a destination line range in a current train operation plan, regardless of whether the turnout is included within the range of the line.

In a5), if the trackside control system checks an obstacle point existing in front of the train within the destination line range in the current train operation plan, whether the front obstacle point is cleared is detected in real time, and the movement authority from the train to the obstacle point is updated and established.

In a6), after the interlocking system locks the turnout (after step a3), the interlocking system activates a turnout movement authority locked state, which can be unlocked only by the trackside control system. The trackside control system checks whether a train route in the same direction as the movement authority is included within the range of the movement authority; if so, a route establishment command is sent to the interlocking system; the interlocking system checks whether a route condition is satisfied; if satisfied, a route is locked and the signal is cleared; and if not satisfied, a current state of the route is maintained.

in a7), if the trackside control system checks that an obstacle point in front of the train within the destination line range in the current train operation plan is removed, a movement authority from the train to the destination of the operation plan is established; and a movement authority state is sent to the dispatching supervision system.

In a8), the train in the moving block mode is operated to the end point of the currently established movement authority according to the range of the movement authority (on the basis of step a5 and step a8).

In a9), if the interlocking system determines that the route is locked (step a6), a signal clearing command is sent to a trackside signal machine, which sends, after receiving a signal cleared state, the signal cleared state to the dispatching supervision system.

In a10), the train in the degraded mode is operated according to the clearing signal and according to signal display.

Figure 2:
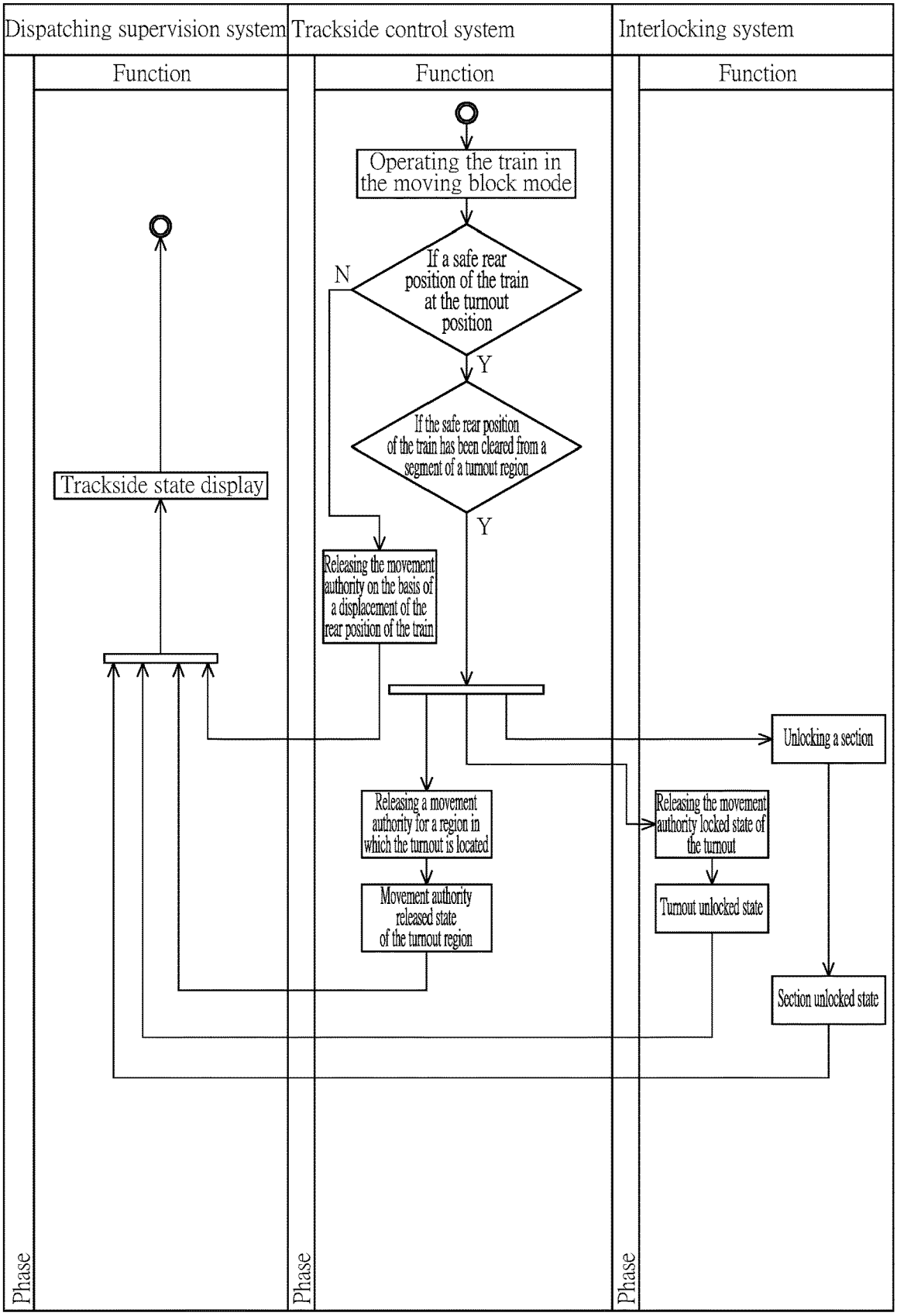
FIG. 2 is a flowchart of a process of releasing a movement authority according to the present invention.

Referring to FIG. 2, the implementation steps of releasing the movement authority are as follows.

In b1), after the movement authority is established for the train in the moving block mode, the train is operated on the basis of the target point and direction according to the movement authority.

In b2), the trackside control system determines whether the safe rear position of the train is in a turnout region; if not, the train displaces along the direction of the movement authority on the basis of the rear position of the train to release a movement authority for this displacement distance, and a state is sent to the dispatching supervision system; and if so, it is checked that the safe rear position of train has been cleared from a segment of the turnout region.

In b3), the trackside control system determines that the safe rear position of train has been cleared from a segment of the turnout region, a movement authority for the region where the turnout is located, is released; and a command of releasing a movement authority locked state of the turnout and unlocking a turnout section is sent to the interlocking system.

In b4), the trackside control system sends a movement authority released state of the turnout region to the dispatching supervision system.

In b5), the interlocking system sends a turnout unlocked state and a section locked state to the dispatching supervision system after receiving the command of releasing the movement authority locked state of the turnout and unlocking the turnout section (step b3).

Figure 3:
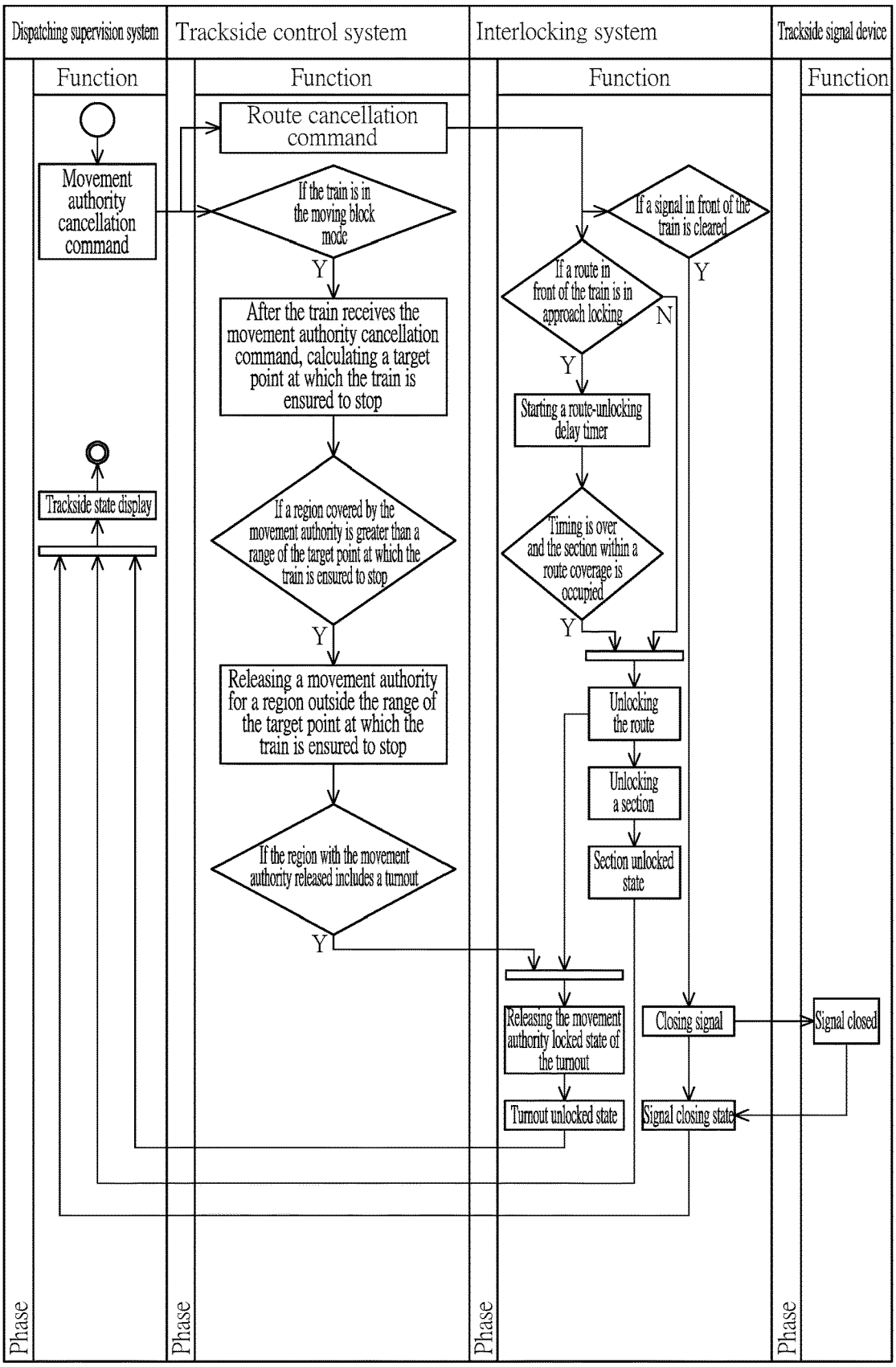
FIG. 3 is a flowchart of a process of manually releasing a movement authority according to the present invention.

Referring to FIG. 3, the implementation steps of manually releasing the movement authority are as follows.

In c1), a dispatcher handles a movement authority cancellation command in the dispatching supervision system, and the dispatching supervision system sends the command to the trackside control system.

In c2), the trackside control system determines whether the train is in the moving block mode; and if so, a target point, at which the train is ensured to stop, is calculated on the basis of information on current speed per hour and line grade in the received movement authority cancellation command.

In c3), the trackside control system determines that the train is not in the moving block mode, a command of canceling a route within the range of the movement authority is sent to the interlocking system; the interlocking system checks whether a front route of the train is in approach locking and simultaneously checks whether a signal in front of the train is cleared; if the signal is cleared, a signal closing command is sent to a trackside signal machine; and after a closed state of the signal machine is acquired, the interlocking system sends a signal closed state to the dispatching supervision system.

In c4), after the interlocking system receives the movement authority cancellation command, the interlocking system starts a route-unlocking delay timer if the interlocking system determines that the route in front of the train is in approach locking.

In c5), when timing of the route-unlocking delay timer is over and no section is occupied within a route coverage, or when the route in front of the train is not in approach locking as a route cancellation command is received from the trackside control system, the interlocking system unlocks the route in front of the train and a turnout in the route.

In c6), after the trackside control system determines the target point at which the train is ensured to stop, if a region covered by the movement authority is greater than a range of the target point at which the train is ensured to stop, a movement authority is released for a region outside the range of the target point at which the train is ensured to stop.

In c7), the trackside control system checks whether the released region with the movement authority includes a turnout; if a turnout is included, a command of releasing a movement authority locked state of the turnout is sent to the interlocking system; the interlocking system executes releasing of turnout locking, and then, sends a turnout unlocked state to the dispatching supervision system.

In c8), after the route in front of the train is unlocked (step c5), the interlocking system unlocks a section and sends a section unlocked state to the dispatching supervision system.

The above description only provides the specific embodiments of the present invention, but the protection scope of the present invention is not limited thereto. A variety of equivalent modifications or substitutions readily conceivable to a person skilled in the art within the technical scope disclosed by the present invention should be included within the protection scope of the present invention. Therefore, the protection scope of the present invention should be subjected to the protection scope of the claims.

What is claimed is:

1. An implementation method for an independent multimode train control system based on a trackside platform, wherein a trackside train control system and an interlocking system are provided independently in the method to meet requirements of a hybrid operation of trains having different systems; and at the same time, during an operation of a train in a moving block mode, once a trackside control system fails or a train on-board system fails, the multimode train control system can ensure that the train is degraded automatically and operates according to a degraded mode, wherein the implementation method comprises: a process of establishing a movement authority; a process of releasing the movement authority; and a process of manually releasing the movement authority, wherein the process of establishing the movement authority specifically comprises:

a1) applying a movement authority for a train by the dispatching supervision system according to an operation plan, and sending a movement authority applying for a current portion of line to the trackside control system;

a2) in case of the movement authority applied for the train, checking, by the trackside control system, whether a movement authority condition is satisfied within a range of the applied movement authority, if the movement authority condition is satisfied with respect to all or a portion of the line for which the movement authority is applied, checking whether the current portion of line for which the movement authority is applied includes a turnout, and if the movement authority condition is not satisfied with respect to all regions or a portion of the line within the range of the applied movement authority, activating, by the trackside control system, a movement authority applied state for all or a portion of the line that does not satisfy the condition, and continuously checking the movement authority condition within the line;

a3) if the movement authority condition is satisfied with respect to all or a portion of the line for which the movement authority is applied and the current portion of the line includes a turnout, checking and determining, by the trackside control system, whether a turnout position is a desired position of the movement authority applied, if not, outputting a turnout operating command to the interlocking system, which in turn outputs, upon receipt, the turnout operating command to a trackside turnout switch machine, acquires a turnout position state from a trackside signal device in real time, and sends the turnout position state to the dispatching supervision system, and if so, sending, by the trackside control system, an indication of locking all turnouts in the portion of line to the interlocking system, which in turn sends a turnout locked state to the dispatching supervision system;

a4) if the movement authority condition is satisfied with respect to all or a portion of the line for which the movement authority is applied, checking, by the trackside control system, whether an obstacle point exists in front of the train within a destination line range in a current train operation plan, regardless of whether the turnout is included within the range of the line;

a5) if the trackside control system checks an obstacle point existing in front of the train within the destination line range in the current train operation plan, detecting, in real time, whether the front obstacle point is cleared, and updating and establishing the movement authority from the train to the obstacle point;

a6) after the interlocking system locks the turnout, activating, by the interlocking system, a turnout movement authority locked state, which can be unlocked only by the trackside control system, checking, by the trackside control system, whether a train route in the same direction as the movement authority is included within the range of the movement authority, if so, sending a route establishment command to the interlocking system, checking, by the interlocking system, whether a route condition is satisfied, if satisfied, locking a route and clearing a signal, and if not satisfied, maintaining a current state of the route;

a7) if the trackside control system checks that an obstacle point in front of the train within the destination line range in the current train operation plan is removed, establishing a movement authority from the train to the destination of the operation plan, and sending a movement authority state to the dispatching supervision system;

a8) operating the train in the moving block mode to the end point of the currently established movement authority according to the range of the movement authority;

a9) if the interlocking system determines that the route is locked, outputting a signal clearing command to a trackside signal machine, which sends, after receiving a signal cleared state, the signal cleared state to the dispatching supervision system; and a10), operating the train in the degraded mode according to the clearing signal and according to signal display.

2. The implementation method for the independent multimode train control system based on the trackside platform according to claim 1, wherein when receiving an application for the movement authority from a dispatching supervision system for a specified operating train, the trackside control system determines a direction of the movement authority according to a destination and a path in the application for the movement authority, and calculates a starting point of the movement authority on a basis of a safe rear position of the train, and an end point of the movement authority depends on whether an obstacle point exists on the whole path applied for the movement authority.

3. The implementation method for the independent multimode train control system based on the trackside platform according to claim 2, wherein if no obstacle point exists on the whole path applied for the movement authority, the end point of the movement authority is used to define a farthest distance for the movement authority of the train, and if an obstacle point exists on the path applied for the movement authority, the end point of the movement authority will be extended or withdrawn to the obstacle point; and between the obstacle point and the destination of the applied movement authority, the trackside control system will activate the movement authority to an applied state.

4. The implementation method for the independent multimode train control system based on the trackside platform according to claim 3, wherein if the obstacle point is a turnout, which is not located at a desired position of the movement authority and is in a region with a movement authority applied state, and in the event that other conditions of a permissible action of the turnout are satisfied, the trackside control system outputs a turnout operating command to the interlocking system, and once a position of the turnout reaches the desired position of the movement authority, the trackside control system will send a turnout locking command to the interlocking system; and if the trackside control system receives a state that the turnout is a locked by the movement authority, and no obstacle point exists between the train and a section in which the turnout is located, a movement authority for the section of the turnout is activated for the train.

5. The implementation method for the independent multimode train control system based on the trackside platform according to claim 3, wherein if a range of the movement authority covers a segment of train route in the same direction, the trackside control system sends, to the interlocking system, a train route establishment command, and in the event that relevant conditions of the route are satisfied, the interlocking system locks the route and clears a signal; and in the event that the movement authority has been established, if a condition for establishing a route within a range of the movement authority is not satisfied, the interlocking system sends a logical clearing state of a route starting-terminal signal machine to a train control center, and for a turnout that has been locked by the movement authority, the interlocking system sends a section locked state of the section, where the turnout is located, to the train control center, and if degradation occurs at any time, the train can be controlled on the basis of a track circuit system to maintain subsequent operation.

6. The implementation method for the independent multimode train control system based on the trackside platform according to claim 2, wherein a section direction is triggered by a route handled by the interlocking system, and once the section direction is established and the movement authority applied by the dispatching system for the train is consistent with the section direction, a corresponding movement authority is established on the basis of a front obstacle point.

7. The implementation method for the independent multimode train control system based on the trackside platform according to claim 1, wherein the process of releasing the movement authority comprises:

b1), after the movement authority is established for the train in the moving block mode, operating the train on the basis of the target point and direction according to the movement authority;

b2) determining, by the trackside control system, whether the safe rear position of the train is in a turnout region, if not, moving the train along the direction of the movement authority on the basis of the rear position of the train, releasing a movement authority for a current movement displacement distance, and sending a state to the dispatching supervision system, and if so, checking that the safe rear position of train has been cleared from a segment of the turnout region;

b3) determining, by the trackside control system, that the safe rear position of train has been cleared from a segment of the turnout region, releasing a movement authority for the region where the turnout is located, and sending, to the interlocking system, a command of releasing a movement authority locked state of the turnout and unlocking a turnout section;

b4) sending, by the trackside control system, a movement authority released state of the turnout region to the dispatching supervision system; and b5) sending, by the interlocking system, a turnout unlocked state and a section locked state to the dispatching supervision system after receiving the command of releasing the movement authority locked state of the turnout and unlocking the turnout section.

8. The implementation method for the independent multimode train control system based on the trackside platform according to claim 1, wherein the process of manually releasing the movement authority specifically comprises:

c1) handling, by a dispatching terminal, a movement authority cancellation command in the dispatching supervision system, and sending, by the dispatching supervision system, the command to the trackside control system;

c2) determining, by the trackside control system, whether the train is in the moving block mode, and if so, calculating a target point, at which the train is ensured to stop, on the basis of information on current speed per hour and line grade in the received movement authority cancellation command;

c3) determining, by the trackside control system, that the train is not in the moving block mode, sending to the interlocking system a command of canceling a route within the range of the movement authority, checking, by the interlocking system, whether a front route of the train is in approach locking and simultaneously checking whether a signal in front of the train is cleared, if the signal is cleared, sending a signal closing command to a trackside signal machine, and after a closed state of the signal machine is acquired, sending, by the interlocking system, a signal closed state to the dispatching supervision system;

c4) after the interlocking system receives the movement authority cancellation command, starting, by the interlocking system, a route-unlocking delay timer if the interlocking system determines that the route in front of the train is in approach locking;

c5) when timing of the route-unlocking delay timer is over and no section is occupied within a route coverage, or when the route in front of the train is not in approach locking as a route cancellation command is received from the trackside control system, unlocking, by the interlocking system, the route in front of the train and a turnout in the route;

c6) after the trackside control system determines the target point at which the train is ensured to stop, releasing, if a region covered by the movement authority is greater than a range of the target point at which the train is ensured to stop, a movement authority for a region outside the range of the target point at which the train is ensured to stop;

c7) checking, by the trackside control system, whether the released region with the movement authority includes a turnout, if a turnout is included, sending, to the interlocking system, a command of releasing a movement authority locked state of the turnout, executing, by the interlocking system, releasing of turnout locking, and then, sending, by the interlocking system, a turnout unlocked state to the dispatching supervision system; and c8) after the route in front of the train is unlocked, unlocking a section and sending a section unlocked state to the dispatching supervision system, by the interlocking system.

* * * * *